US009936784B2

(12) United States Patent
Nardi

(10) Patent No.: US 9,936,784 B2
(45) Date of Patent: Apr. 10, 2018

(54) HAIR CURLING SYSTEM

(71) Applicant: Maria Nardi, Brookline, NH (US)

(72) Inventor: Maria Nardi, Brookline, NH (US)

( * ) Notice: Subject to any disclaimer, the term of this patent is extended or adjusted under 35 U.S.C. 154(b) by 0 days.

(21) Appl. No.: 14/957,252

(22) Filed: Dec. 2, 2015

(65) Prior Publication Data

US 2017/0156470 A1 Jun. 8, 2017

(51) Int. Cl.

| | |
|---|---|
| ***A45D 7/00*** | (2006.01) |
| ***A45D 2/02*** | (2006.01) |
| *A45D 2/00* | (2006.01) |

(52) U.S. Cl.

CPC ..... *A45D 2/02* (2013.01); *A45D 7/00* (2013.01); *A45D 2002/007* (2013.01)

(58) Field of Classification Search

CPC ..... A45D 2002/007; A45D 2002/005; A45D 2002/006; A45D 8/36; A45D 8/34; A45D 2008/345; A45D 2/127

USPC ..... 132/270, 222

See application file for complete search history.

(56) References Cited

U.S. PATENT DOCUMENTS

| | | | | | |
|---|---|---|---|---|---|
| 3,081,781 | A * | 3/1963 | Stermer | A45D 8/34 | 132/273 |
| 3,751,769 | A * | 8/1973 | Reiner | A45D 8/34 | 132/273 |
| 5,156,171 | A * | 10/1992 | Goodman | A45D 8/34 | 132/200 |
| 5,655,224 | A * | 8/1997 | Sears | A45D 8/34 | 132/273 |
| 5,727,574 | A * | 3/1998 | Frye | A45D 2/00 | 132/210 |
| 5,778,904 | A * | 7/1998 | Elsner | A45D 8/34 | 132/275 |
| D396,545 | S * | 8/1998 | Campbell | D2/880 | |
| 2002/0056467 | A1 * | 5/2002 | Srivastava | A45D 8/00 | 132/273 |

* cited by examiner

*Primary Examiner* — Todd E Manahan
*Assistant Examiner* — Brianne Kalach
(74) *Attorney, Agent, or Firm* — Jeanette Meng Nakagawa

(57) ABSTRACT

A hair curling system embodying a novel device and method for overnight use is provided. The hair curling system includes a sectioning tool and a separate curling strip. The sectioning tool may include an elastic cord forming a loop shape, wherein a stopper member is disposed there along. The curling strip may include an elongated strip of material that terminates in a collar. The collar may define a collar opening adapted to receive the stopper member. The user may use the sectioning tool to secure a predetermined section of hair whereby the stopper member may subsequently receive the collar and thus hang the attached elongated strip near the scalp of the user. The user may then twirl the predetermined section of hair using the entire curling strip. The sectioning tool is then removed, facilitating a comfortable sleep with at least one curling strip in place.

4 Claims, 4 Drawing Sheets

HAIR CURLING SYSTEM

BACKGROUND OF THE INVENTION

The present invention relates to beauty accessories and, more particularly, a hair curling system embodying a novel device and method for overnight use.

For those interested in curling their hair without the use of chemical solutions, heating elements or electric devices, overnight hair curling systems and methods are their best bet. Unfortunately, such current options are not comfortable to sleep in. Traditional hair curlers roll up to the scalp, making them unsuitable for sleeping. Even soft spongy curlers are uncomfortable to sleep in because of their bulk near the scalp as well as the plastic frame they sit in. Likewise, current overnight hair curling options tend to be bulky because they roll up to the scalp or are otherwise made of rigid material, making them uncomfortable to sleep in.

Moreover, curling irons, whether ceramic-coated or not, damage and dry the hair and are also not safe for children to use unassisted.

As can be seen, there is a need for a hair curling system embodying a novel device and method for overnight use, where the device does not roll up toward the scalp so as to be more comfortable for sleeping overnight.

SUMMARY OF THE INVENTION

In one aspect of the present invention, a hair curling strip includes an elongated strip of a material extending from a distal end to a collar end, wherein the material is adapted to wrap about human hair without entangling thereto; and a collar attached to the collar end, wherein the collar forms a collar opening, whereby a user may removably secure the collar opening near the scalp of a human user when wrapping the elongated strip about their hair.

In another aspect of the present invention, a hair curling system includes a hair curling strip having an elongated strip of a material extending from a distal end to a collar end, wherein the material is adapted to wrap about human hair without entangling thereto; and a collar attached to the collar end, wherein the collar forms a collar opening; and a sectioning tool having an elastic cord forming a cord opening.

In yet another aspect of the present invention, a method of curling hair includes the steps of providing a hair curling strip comprising an elongated strip of a material extending from a distal end to a collar end, wherein the collar end is attached to a collar forming a collar opening; providing a sectioning tool comprising an elastic cord attached to a stopper member, wherein the elastic cord forms a cord loop; bundling a predetermined section of hair at a portion thereof by wrapping the elastic cord at least once around the portion thereof; securing the bundled predetermined section of hair by passing the stopper member through the cord loop; passing the stopper member through the collar opening; and wrapping the elongated strip about a remaining portion of the bundled predetermined section of hair.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hair curling system embodying a novel device and method for overnight use, where the device does not roll up toward the scalp so as to be more comfortable for sleeping. The hair curling system includes a curling strip, which may be applied by using a sectioning tool. The sectioning tool may include an elastic cord forming a loop shape, wherein a stopper member is disposed along a portion of the elastic cord. The curling strip may include an elongated strip of material that terminates in a collar. The collar may define a collar opening adapted to receive the stopper member. The user may use the sectioning tool to secure a predetermined section of hair whereby the stopper member may subsequently receive the collar and thus hang the attached elongated strip near the scalp of the user. The user may then twirl the predetermined section of hair using the entire curling strip, which is wrapped back to the top of the head and inserted into the collar after the stopper member is removed. Subsequently, the sectioning tool can be removed and used again for sectioning another predetermined section of hair. The user may then sleep with the at least one curling strip to wake up to curled hair.

Referring to FIGS. 1 through 5, the present invention may include a hair curling system 100 embodying a curling strip 10 and method for overnight hair curling, facilitating a comfortable sleeping.

Figure 3A:
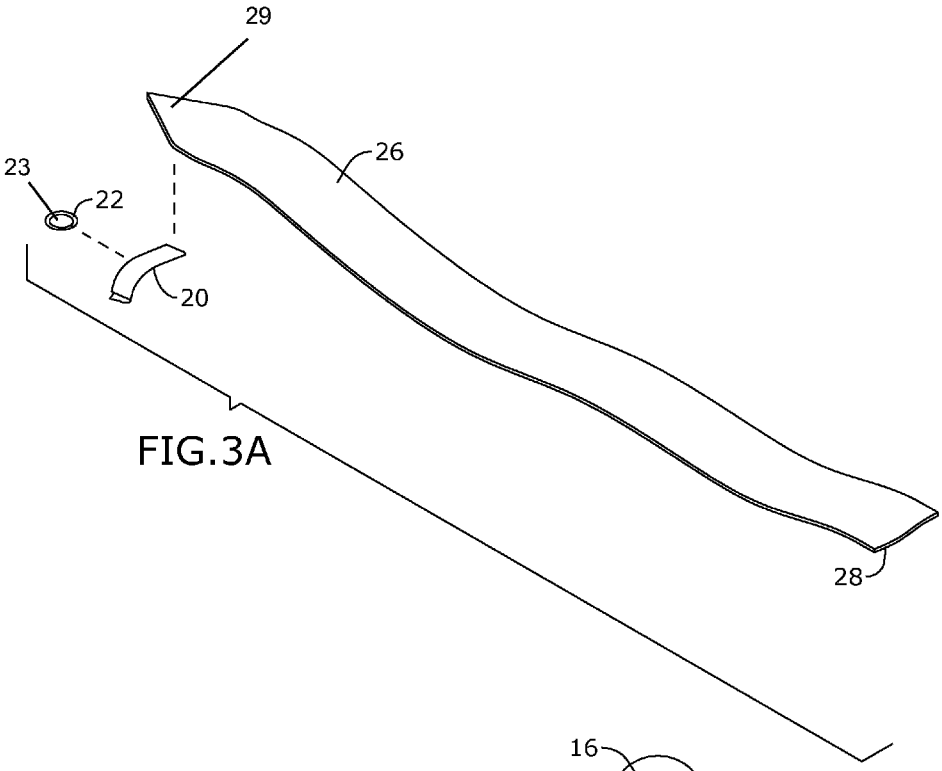
FIG. 3A is an exploded view of an exemplary embodiment of the curling strip of the present invention.
Figure 3B:
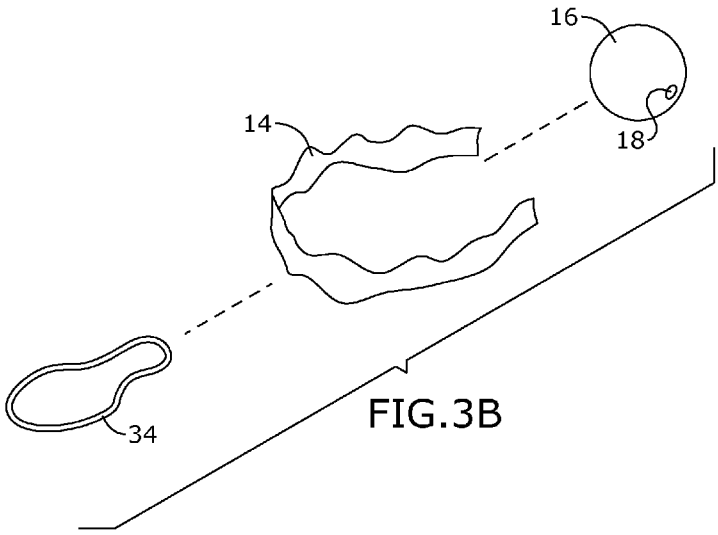
FIG. 3B is an exploded view of an exemplary embodiment of the sectioning tool of the present invention.
Figure 4:
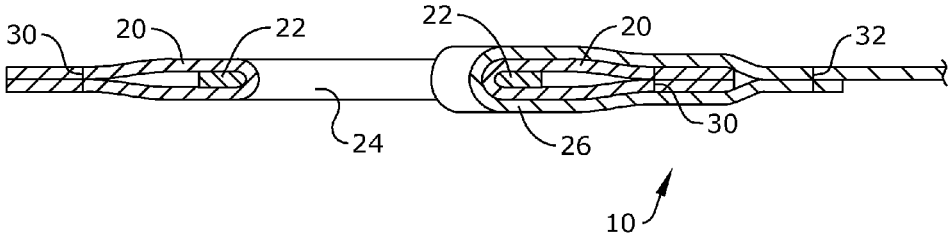
FIG. 4 is a section view of an exemplary embodiment of the curling strip of the present invention, taken along line 4-4 in FIG. 2A.
Figure 5:
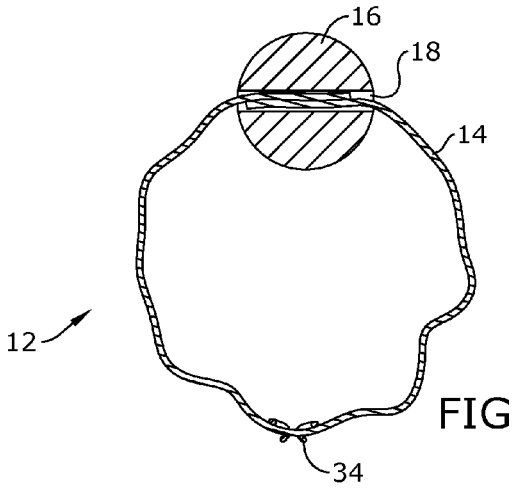
FIG. 5 is a section view of an exemplary embodiment of the sectioning tool of the present invention, taken along line 5-5 in FIG. 2B.

The curling strip 10 may include an elongated strip 26 and a collar 22. The elongated strip 26 may extend from a distal end 28 to an opposing collar end 29. The elongated strip 26 may be made of any soft pliable material, such as cotton or including but not limited to medium weight non-pilling fleece, adaptable to removably wrap about the user's hair without entanglement, clinging, knotting with itself and/or the hair. The collar end 29 may be tapered. In certain embodiments, the elongated strip 26 may be approximately two and a half inches in width by 24 inches in length, the length being from the distal end 28 to the collar end 29. In such an embodiment the collar end 29 may taper at approximately 45 degrees toward a point, as illustrated in FIG. 3A, wherein the tapered collar end 29 is approximately two inches in length.

Figure 1:
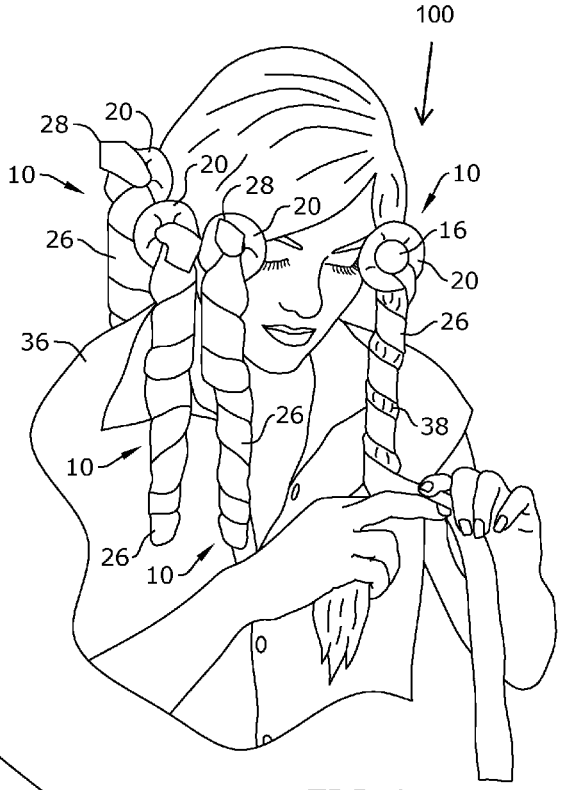
FIG. 1 is a perspective view of an exemplary embodiment of the present invention, shown in use.
Figure 2A:
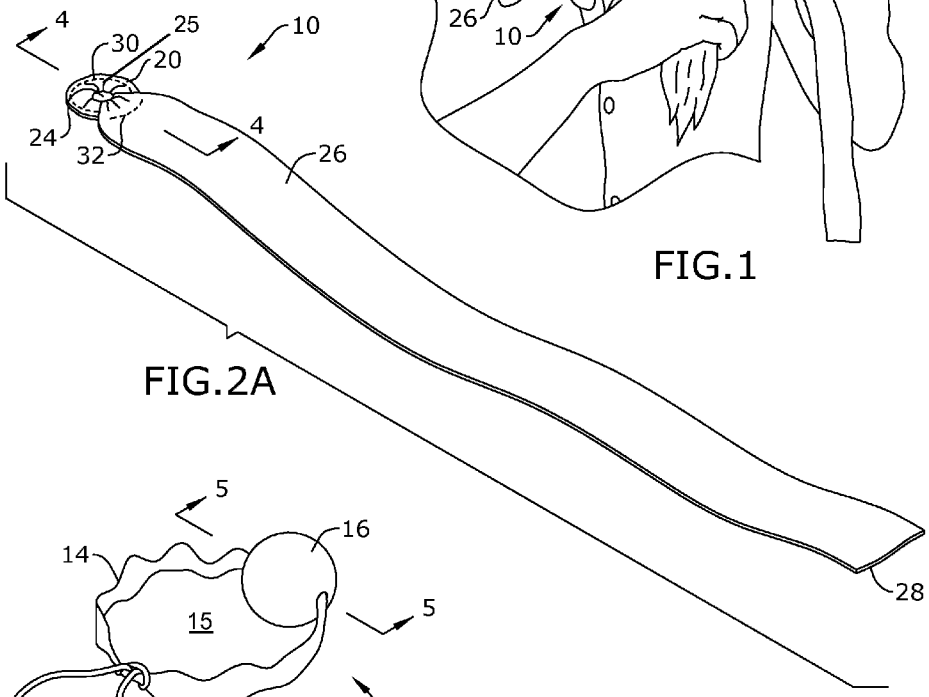
FIG. 2A is a perspective view of an exemplary embodiment of a curling strip of the present invention.

The collar 22 may define a collar opening 23. The collar opening 23 may be further defined by a separate loop strip 20 that is attach along the collar 22 (by loop stitching 30 or other suitable attachment) so that a portion of the loop strip 25 extends into the collar opening 23, forming a partitioned opening 24, as illustrated in FIG. 2A. As a result of the portion of the loop strip 25, a biased partition ("or diaphragm 25") is provided to a portion of the collar opening 23 that is greater than the partitioned opening 24. Thus the diaphragm 25 resists solid objects having a greater periphery than the partitioned opening 24 from passing therethrough, yet the diaphragm 25 is flexible enough that said solid objects can be urged therethrough (assuming they their periphery is smaller than the collar opening 23. Thereby, the collar opening 24 may be dimensions and adapted by the diaphragm 25. The collar end 29 may be attached to collar 22 and/or the loop strip 20 by strip stitching 32 or other suitable attachment.

Figure 2B:
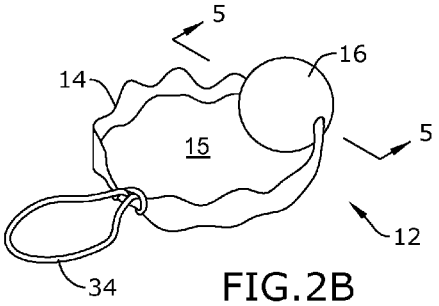
FIG. 2B is a perspective view of an exemplary embodiment of a sectioning tool of the present invention.

The hair curling system 100 may include a sectioning tool 12. The sectioning tool 12 may include an elastic cord 14 forming a cord opening 15. The elastic cord 14 may be formed of one or more elastic strands, each strand may be composed of one or more material. The elastic cord 14 may include, but not be limited to, "bungee cords", flexible ribbons and the like. The cord opening 15 may form a general loop shape, as illustrated in FIG. 2B.

The sectioning tool 12 may include a stopper member 16 dimensioned to have a size greater than the partitioned opening 24 but smaller than the larger collar opening 23. The stopper member 16 may be adapted to secure the sectioning tool 12 about a predetermined section of hair 38, without a user 36 having to tie a knot in the elastic cord 14 or inserting the predetermined section of hair 38 through the cord opening 15, which would prevent the user 36 from detaching the sectioning tool 12 once the predetermined section of hair 38 is wrapped by the elastic cord 14 or the elongated strip 26. The stopper member 16 enables the user 36 to removably maintain a desired tension about the predetermined section of hair 38, the tension being established by the number of times the user 36 wraps the elastic cord 14 about said predetermined section of hair 38. In certain embodiments, the stopper member 16 prevents the elastic cord 14 from unraveling about the predetermined section of hair 38, in some instances, by being passed through the cord opening 15 at least once. The stopper member 16 may include a block of material (e.g., a molded plastic block, wood and the like) and be any shape, e.g., a spheroid, so long as the shape functions in accordance with the present invention as described herein; namely, enabling the removably securing of the sectioning tool 12 and removably engaging the curling strip 10. The stopper member 16 may form a passageway 18 through its body for attaching the stopper member 16 along the elastic cord 14.

The sectioning tool 12 may also include an elastic pull loop 34 typically attached along the elastic cord 14 opposite the stopper member 16 for quick and easy detachment of the sectioning tool 12 from the predetermined section of hair 38. In certain embodiments, the sectioning tool 12 may be dimensioned and adapted so as to serve as a guide for the predetermined section of hair 38 that should be sectioned. When forming a possible predetermined section of hair, if the sectioning tool 12 does not stay in place, the user needs to add more hair to the predetermined section of hair 38. The sectioning tool 12 may be secured to the predetermined section of hair 38 so as to control the tightness/looseness/tension of the desired curl.

Figure 6:
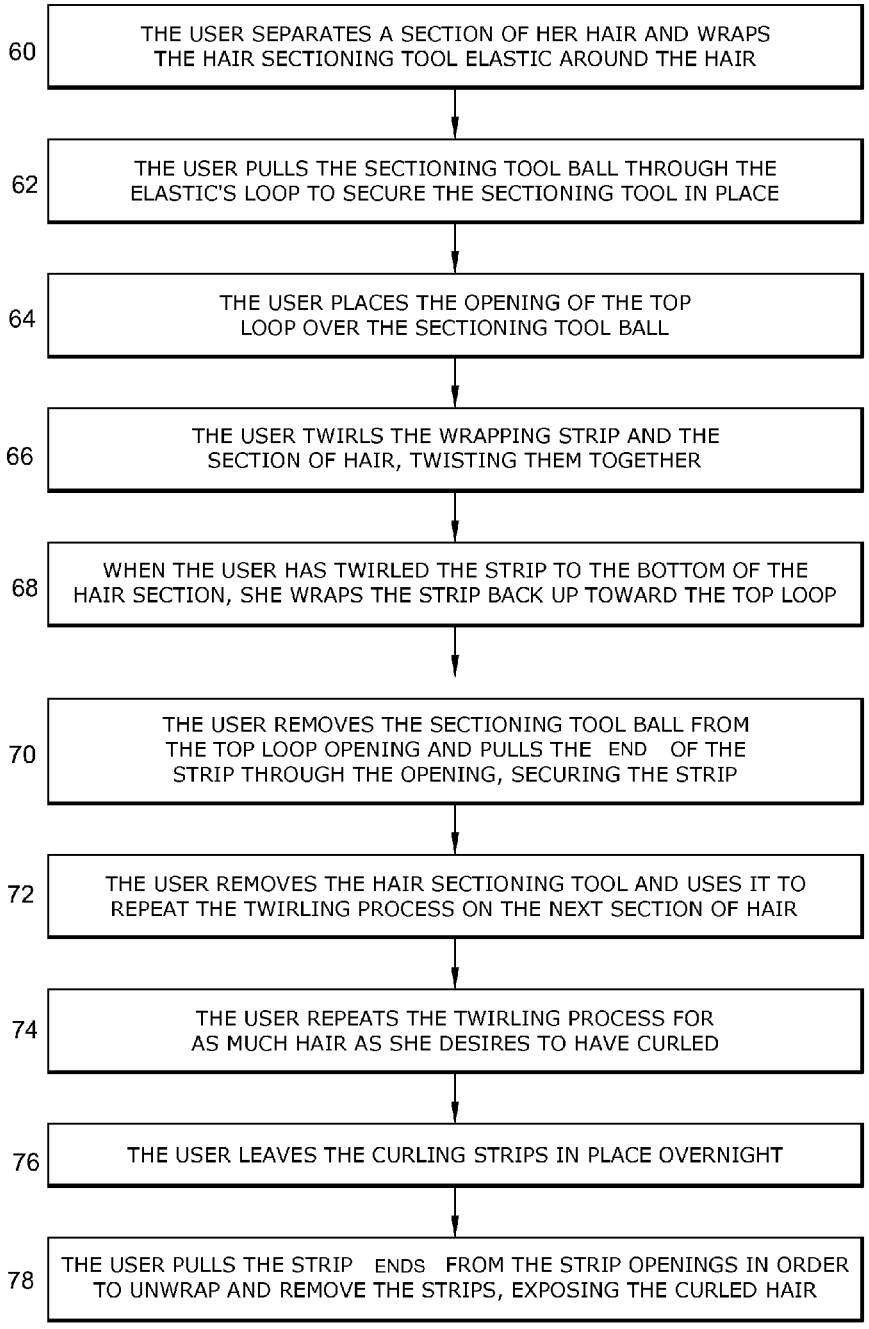
FIG. 6 is a flow chart of an exemplary embodiment of the present invention.

Referring to FIG. 6, a method of using the present invention may include the following. The hair curling system 100 disclosed above may be provided. A user may first lightly dampen the hair, for example, with a water spray bottle or damp towel. In certain embodiments, the hair curling system 100 may be used with dry hair since the curling strip 10 is kept in overnight. Next in step 60, the sectioning tool 12 may be used to section the predetermined section of hair 38 before curling by securing the elastic cord 14 around the predetermined section of hair 38 near the head of the user 36. In step 62, the user may pull the stopper member 16 through the cord opening 15 to secure the sectioning tool 12. Once the sectioning tool 12 is in place, the collar opening 23 of the curling strip 10 may receive the stopper member 16, in step 64. Next in step 66, the predetermined section of hair 38 is wrapped around the elongated strip 26 and/or the elongated strip 26 is wrapped around the predetermined section of hair 38 starting near the collar end 29. In step 68, the elongated strip 26 may be wrapped back up to the top of the predetermined section of hair 38 near the collar 22. The stopper member 16 may be removed from the collar opening 23 and the distal end 28 may now be inserted into the collar opening 23 and/or attach thereto, in step 70, so as to removably secure the curling strip 10 to the predetermined section of hair 38 for curling said hair 38.

In step 72, the sectioning tool 12 may then easily be unlatched, from the predetermined section of hair 38 and ready to be used on another predetermined section of hair 38. In certain embodiments, the elastic pull loop 34 may be urged so as to unlatch the elastic cord 14 from the hair. In step 74, the user 36 may then choose to secure at least one additional hair curling strip to their hair. Finally, once the desired amount of hair is wrapped, the user simply sleeps in the at least one curling strip 10 overnight, in step 76, and then unwraps each curling strip 10 by detaching the distal end 28 from the collar opening 24, exposing the curled predetermined section of hair 38, in step 78.

It should be understood, of course, that the foregoing relates to exemplary embodiments of the invention and that modifications may be made without departing from the spirit and scope of the invention as set forth in the following claims.

What is claimed is:

1. A method of curling hair comprising:

providing at least one hair curling strip extending from a distal end to a collar end, wherein the collar end is attached to a collar forming a collar opening;

providing at least one sectioning tool comprising an elastic cord attached to a stopper member, wherein the elastic cord forms a cord loop;

bundling and securing a predetermined portion of hair near a user's scalp by wrapping the elastic cord at least once around the portion thereof over the stopper member;

securing the hair curling strip by passing the stopper member through the collar opening;

wrapping the portion of hair around the hair curling strip at least once starting near the collar end in a periodic fashion;

covering an interwound portion of hair and strip by reverse wrapping the curling strip over thereof; and securing the curling strip by looping its distal end through the collar opening at least once.

2. The method of curling hair of claim 1, wherein the stopper member is released from the collar opening and from the portion of hair after the curling strip is applied, and the sectioning tool is re-applied at least once on a different section of hair.

3. The method of curling hair of claim 1, wherein the collar further comprising a diaphragm extending from an inner periphery of the collar so as to define a partitioned opening within the collar opening, and wherein the stopper member is dimensioned to be greater than the partition opening.

4. The method of curling hair of claim 1, wherein the sectioning tool further comprising a pull loop attached to the elastic cord.

* * * * *